US005740737A

United States Patent [19]

Polak et al.

[11] Patent Number: 5,740,737

[45] Date of Patent: Apr. 21, 1998

[54] HANDSTAMPING APPARATUS

[75] Inventors: Donald J. Polak, Nashville; Robert E. Ponter, Cookeville, both of Tenn.; Thomas J. Bush, Canton Center, Conn.

[73] Assignee: Identity Group, Inc., Cookeville, Tenn.

[21] Appl. No.: 760,969

[22] Filed: Dec. 5, 1996

[51] Int. Cl.[6] ..... B41K 1/42

[52] U.S. Cl. ..... 101/334; 101/104

[58] Field of Search ..... 101/334, 327, 101/359, 103, 104, 105, 106, 108, 405

[56] References Cited

U.S. PATENT DOCUMENTS

| | | | |
|---|---|---|---|
| 139,486 | 6/1873 | Thomas | 101/327 |
| 1,353,994 | 9/1920 | Folger et al. | 101/103 |
| 1,724,074 | 8/1929 | DuBelle | 101/106 |
| 2,012,472 | 8/1935 | Ludewigs | 101/327 |
| 2,839,994 | 6/1958 | Haag | 101/372 |
| 2,884,858 | 5/1959 | Boekeloo et al. | 101/327 |
| 2,900,902 | 8/1959 | Becker | 101/368 |
| 3,364,855 | 1/1968 | Boekeloo et al. | 101/327 |
| 4,387,645 | 6/1983 | Holland-Letz et al. | 101/327 |

*Primary Examiner*—John S. Hilten
*Assistant Examiner*—Dave A. Ghatt
*Attorney, Agent, or Firm*—Reed Smith Shaw & McClay

[57] ABSTRACT

A handstamping apparatus comprises a first housing member and a second housing member. The first and the second housing members are moveable relative to each other from a first position to a second position. The first position is a ready position and the second position is a print position. A biasing element is coupled to the first and second housing members for biasing the members to the first position. A die support is coupled to the first housing member for movement therewith relative to the second housing member. A printing die is on the die support and the printing die and die support are disposed within a second housing member. The die support and the printing die are moveable relative to the housings from a ready position to a print position. The printing die is in the print position when the housings are disposed in the second position. An ink roller is coupled to the second housing member. The ink roller is disposed within the second housing member and spaced from and out of contact with the printing die when the housing members are in the first position. At least one connection interconnects the die support at the ink rollers for moving the ink rollers and the printing die relative to each other in response to relative movement of the housings, whereby the ink roller inks the printing die as the housing members move from the first to the second position and the printing die moves to its printing position.

3 Claims, 3 Drawing Sheets

HANDSTAMPING APPARATUS

FIELD OF THE INVENTION

The present invention relates in general to a handstamping apparatus and more particularly to a self-inking handstamp in which the die plate assembly is inked by a roller just before the stamp die makes contact with the article to be stamped and the stamp die does not contact the ink roller when not in use.

BACKGROUND OF THE INVENTION

Historically, handstamping apparatus have been known since the late 1800s. However, the conventional ink pad of the handstamping apparatus does not provide consistent inking of the object to be stamped. In addition, in the conventional apparatus the stamp die and pad are in contact when at rest, which is most of the time, and this leads to several problems. One such problem is that the components of the ink attack the photo-polymer material of the die plate and causes the die plate to deteriorate over time. This causes the letters to swell and distort. Another serious problem is that conventional ink pads take a set over time, depressing at the letter and bulging around the letter. The bulge touches the non-letter areas causing "overprinting". In addition, on the conventional self-inker, the stamp die hits the pad at the same place. Rapid, multiple use depletes the ink, causing a lighter impression on the object to be stamped.

SUMMARY OF THE INVENTION

The present invention provides a high-quality, consistent handstamping apparatus at a reasonable price. In one aspect of the present invention, a handstamping apparatus, includes a first housing member and a second housing member cooperatively associated therewith. The first and second housing members are moveable relative to each other from a first position to a second position, the first position being a ready position and the second position being a print position. A biasing element is coupled to the first and second housing members to bias the members to a first position. A die support is operatively coupled to the first housing member for movements relative to the second housing member. The die support includes a printing die. The printing die and die support are disposed within the second housing member and are moveable relative to this housing from a ready position to a print position.

In addition, this printing die is positioned in a print position when the housings are disposed in the second position. An ink roller is operatively coupled to the second housing member, the ink roller being disposed within the second housing member and spaced from and out of contact with the printing die when the housing members are in the first position. A connector interconnects the die support, the ink roller and the printing die relative to each other in response to relative movement of the housings. The ink roller inks the printing die as the housing members move from the first to the second position and the printing die moves to its printing position.

The handstamping apparatus further includes a linkage on the second housing member that is engaged with the die support to move the die support to the print position as the housings move from the first position to the second position. The die support is pivotable relative to the housing members about a first axis disposed transversely with respect to the direction of relative movement of the housing members. The ink roller is rotatable about a second axis spaced from and parallel to the first axis.

In addition, a first shaft supports the die support and includes respective ends coupled to the first housing member, and a second shaft supports the ink roller. A connector interconnects the die support and the ink roller. The ink roller includes a rocker arm pivotably coupled to the second housing member. The first ends of the rocker arms are pivotably and slidably engaged with the first shaft, and the second ends are pivotably and slidably engaged with the second shaft. The relative movement of the housing members causes the ink roller to move and thereby ink the printing die.

Preferably, the first housing member is an outer housing and the second housing member is an inner housing which is slidably received within the first housing member. The first and second housing members have respective pairs of spaced side and end walls. The respective ends of the first shaft are coupled to respective end walls of the first housing member having slots therein, with the respective ends of the first shaft extending through the slots. The first ends of the rocker arms are pivotably and slidably engaged with the first shaft and the second ends of the rocker arms are pivotably and slidably engaged with the second shaft. The ink roller traverses the printing die as the housing members move between the ready position and the second print position. The die support in the ready position is rotated substantially 90 degrees to present the printing die in the print position.

Therefore it is an advantage of this invention that the same roller can be used for all dies of the same length. The ink roll provides a more even layer of ink on the stamp for a better quality impression and the ink impression will be consistent throughout printing. Another advantage is that the ink roller will last longer than the average ink pad since the roller gives up more of its ink as it gives up more of its surface area per inking. The roller will hold ink more efficiently and therefore be less likely to leak. Another advantage is that the roller uses more surface area, enabling it to recover faster and maintain consistent inking over rapid multiple uses. It is yet another advantage of this invention that the ink roller does not remain in contact with the stamp die surface when the stamp is at rest and that the stamp springs are only for pad recovering which allows for much smoother stamp action.

These and other advantages of the invention will be more fully understood from the following detailed description of the invention, taken in conjunction with the accompanying drawings.

BRIEF DESCRIPTION OF THE DRAWINGS

In the accompanying drawings, preferred embodiments of the invention are illustrated by way of example only, wherein.

DESCRIPTION OF PREFERRED EMBODIMENTS

Figure 1:
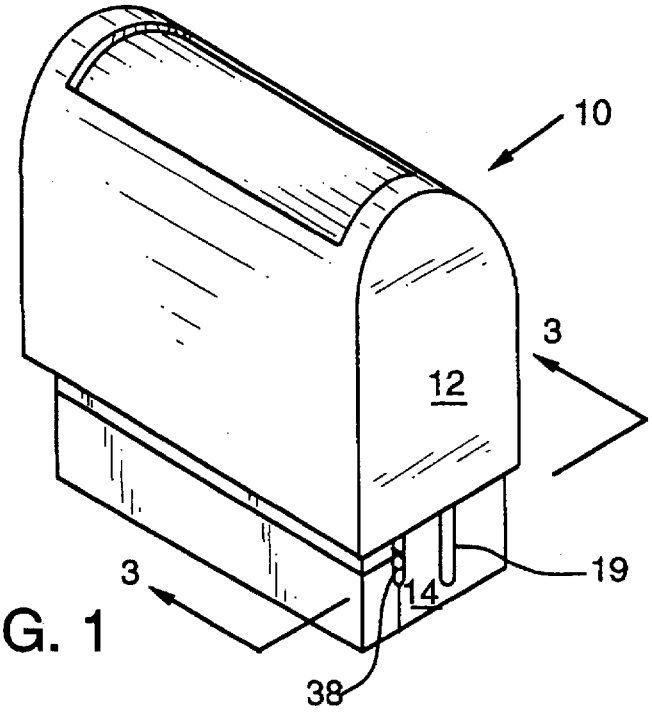
FIG. 1 is a perspective view of a preferred embodiment of the handstamping apparatus.

As shown in FIG. 1, a self-inking hand stamp, in which the die plate assembly is inked by a roller just before the stamp element makes contact with the article to be stamped, comprises a telescoping housing 10, comprising an outer (upper) sleeve 12 and an inner (lower) sleeve 14, telescoped within the outer sleeve 12.

Figure 2:
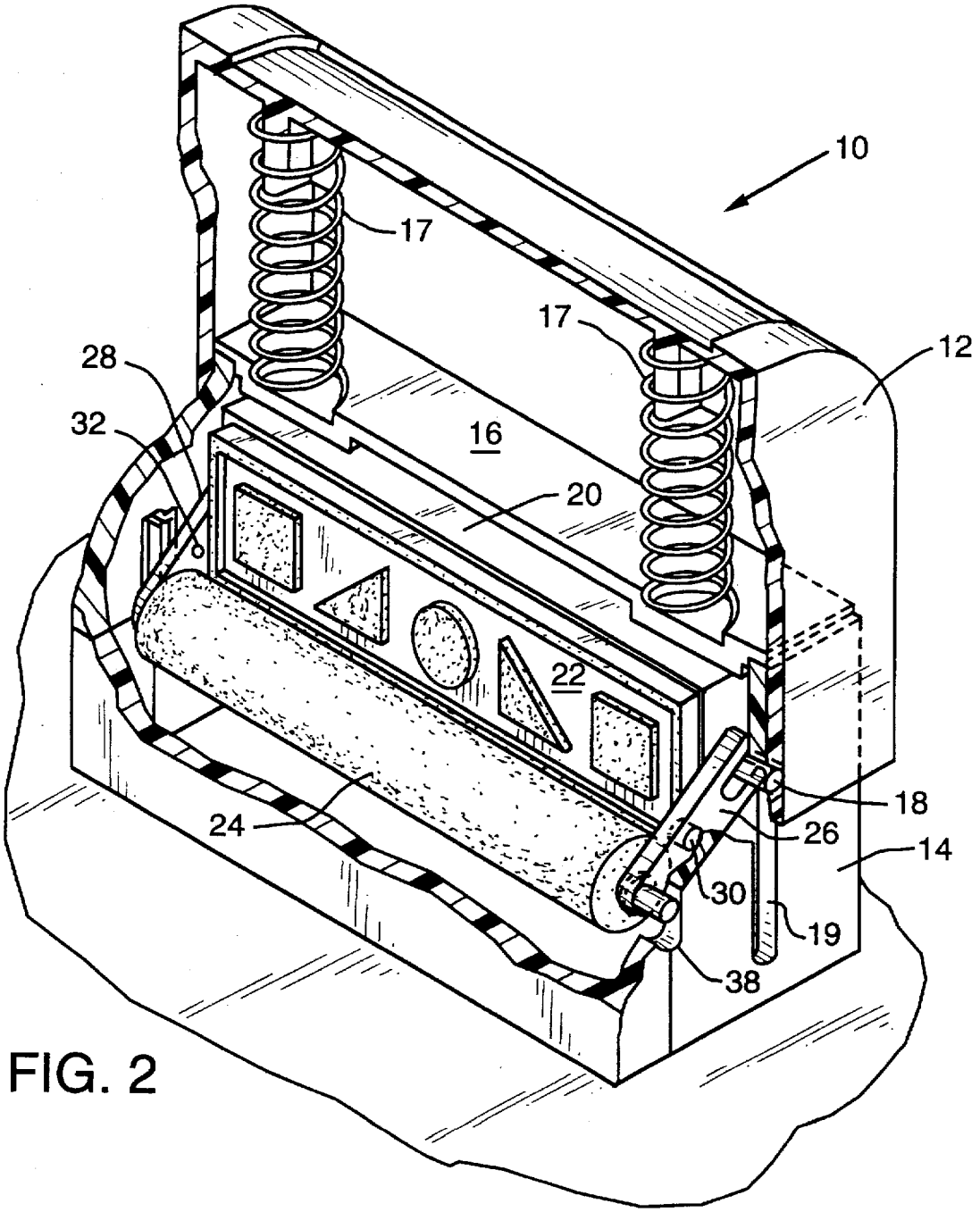
FIG. 2 is a cross-sectional and cut-away view of the handstamping apparatus shown in FIG. 1.

As best shown in FIG. 2, within the housing 10 is a "floating" plate 16, biased downwardly by compression springs 17. The plate 16 and springs 17 serve to bias the outer and inner sleeves 12 and 14 to the initial position seen in perspective (and partly broken away) in FIG. 2.

Affixed to the outer sleeve 12 by a through-shaft 18, and therefore constrained to translate with the outer sleeve 12 relative to the inner sleeve 14, is a rotatable die plate assembly, designated generally by the reference numeral 20. Projecting ends of the shaft 18 ride in a slot 19 in the lower sleeve 14. The die plate assembly 20 rotates substantially 90 degrees about the shaft 18 from its initial orientation seen in FIG. 2, in which the stamp die 22 of the die plate assembly 20 is oriented to the stamping position shown diagonally in FIG. 3.

As hand pressure on the upper sleeve 12 causes the sleeves 12 and 14 to telescope relative to each other, against the bias of springs 17, two essential actions take place. In the first action, the die plate assembly 20, in its initial orientation (see FIG. 4), at first translates downwardly with the upper sleeve 12 and relative to the lower sleeve 14. In so doing, the rubber-like stamp die 22 of the die plate assembly 20 is traversed by an ink roller 24, which applies ink to the stamp die 22. (See FIG. 5) In the second action, the die plate assembly 20, now inked, is made to rotate substantially 90 degrees to present the stamp die 22 to the object to be stamped (see FIG. 3).

Figure 3:
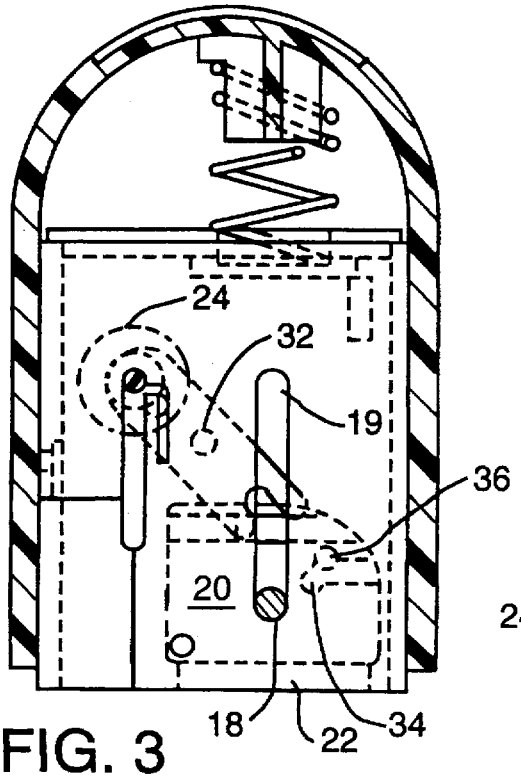
FIG. 3 is a cross-sectional and cut-away view taken along line 3—3 of FIG. 1 showing the die in the print position.
Figure 4:
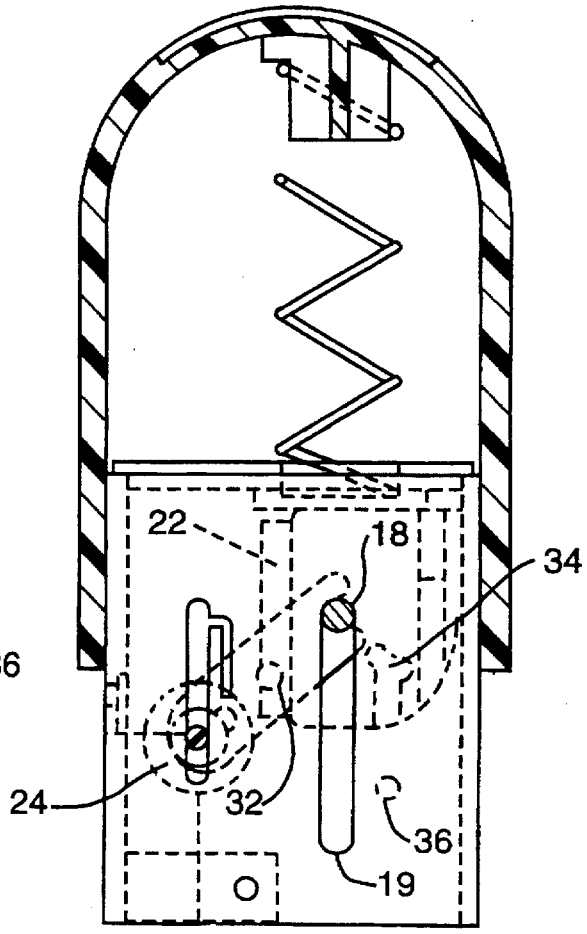
FIG. 4 is a cross-sectional view taken along line 3—3 of FIG. 1 showing the die in the ready position.
Figure 5:
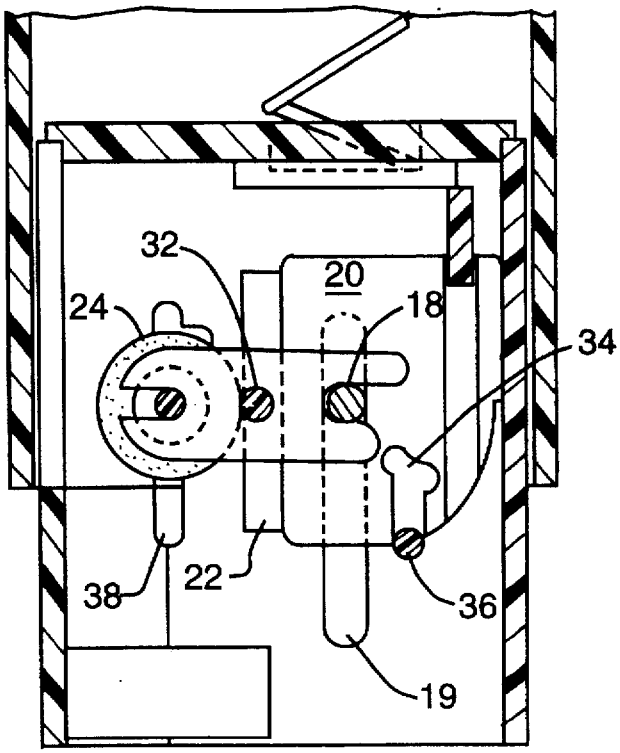
FIG. 5 is an enlarged view showing the die in the inking position.
Figure 6:
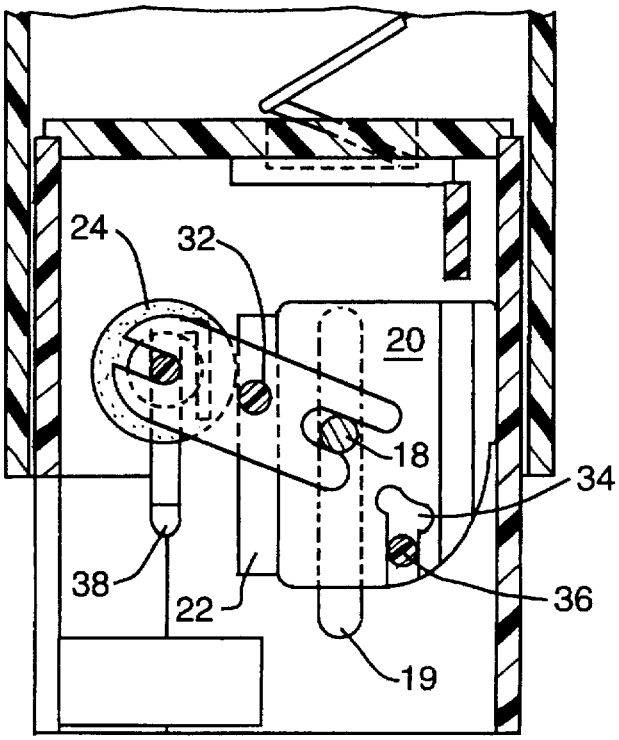
FIG. 6 is an enlarged view of FIGS. 3 and 4 showing the die at the conclusion of the inking operation.

FIGS. 3, 4 and 5 depict, diagramically, that the relative movement occurs because the roller 24 is mounted on a pair of rocker arms 26 and 28, pivoted on coaxial stub shafts 30 and 32 (shown in FIG. 2), affixed to the inner sleeve 14. The throughshaft 18 on which the die plate is mounted drivingly engages one end of each rocker arm 26, 28 to move the ink roller 24 up as the die plate assembly 20 moves down. The above-mentioned substantially 90 degree rotation of the die plate assembly 20, which is translating downwardly with the outer sleeve 12, encounters a camming pin 36 affixed to the inner sleeve 12 (see FIG. 2).

A slot 38 in the inner sleeve 14 (See FIG. 2) controls the path of movement of the roller 24 over the stamp die 22. In this way, roller 24 is the ink-applying medium to the stamp die 22. The stamp die 22 does not contact the ink roller when the device is inactive and therefore does not result in undesirable set patterns on the stamp die 22 and the ink roller 24.

The same roller can be used for all dies of the same length, making it less expensive to manufacture. For example, if stamps were made 1×2, 1½×2, 1¾×2 and 2×2, a different conventional pad would have to be made for each size, whereas one roller of the present invention would cover all of these sizes. Because the roller exposes more area to the stamp die, this enables the roller to recover faster and maintain consistent inking over rapid multiple uses. Since the ink roller gives up more ink because it gives up more surface area, the ink roller also lasts longer. Using this roller provides a more even layer of ink on the stamp die for a better quality impression and more consistent appearance. The stamp action is also much smoother because the springs are used only for roller recovery, not to push a pad and die together.

Although the present invention has been described in detail for the purpose of illustration, it is to be understood that such detail is solely for that purpose and that variations can be made therein by those in the art without departing from the spirit and scope of the invention except as it may be limited by the following claims.

What is claimed is:

1. A handstamping apparatus comprising a first housing member and a second housing member cooperatively associated therewith, said first and said second housing members being movable relative to each other from a first position to a second position, said first position being a ready position and said second position being a print position; a biasing element coupled to said first and said second housing members for biasing said members to said first position; a die support operatively coupled to said first housing member for movement therewith relative to said second housing member, said die support comprising a printing die disposed thereon, said printing die and said die support being disposed within said second housing member and movable relative to said housings from a ready position to a print position, said printing die being in said print position when said housings are disposed in said second position; an ink roller operatively coupled to said second housing member, said ink roller being disposed within said second housing member and spaced from and out of contact with said printing die when said housing members are in said first position; and at least one connector drivingly connecting said die support and said ink roller for moving said ink roller and said printing die relative to each other in response to relative movement of said housings, whereby said ink roller inks said printing die as said housing members move from said first to said second position and said printing die moves to its printing position, and further comprising means on said second housing member engageable with said die support to move said die support to said print position as said housings move from said first position to said second position, wherein said die support is pivotable relative to said housing members about a first axis disposed transversely with respect to the direction of relative movement of said housing members, and said ink roller is rotatable about a second axis spaced from and parallel to said first axis and wherein said first axis comprises a first shaft supporting said die support and having respective ends thereof coupled to said first housing member, and said second axis is provided by a second shaft supporting said ink roller; said at least one connector comprising a rocker arm coupled to said second housing member, said rocker arm having first ends movably engaged with said first shaft and second ends thereof moveably engaged with said second shaft, whereby relative movement of said housing members causes movement of said ink roller to ink said printing die.

2. The apparatus of claim 1, wherein said first housing member is an outer housing and said second housing member is an inner housing, said second housing member being slidably received within said first housing member, said first and said second housing members having respective pairs of spaced side and end walls, said respective ends of said first shaft being coupled to respective end walls of said first housing member having slots therein, said respective ends of said first shaft extending through said slots; said first ends of said rocker arms being pivotably and slidably engaged with said first shaft and said second ends of said rocker arms being pivotably and slidably engaged with said second shaft, whereby said ink rollers traverse said printing die as said housing members move between said ready position and said second print position.

3. The apparatus of claim 2, wherein said die support in said ready position is rotated substantially 90 degrees to present said printing die in said print position.

* * * * *